United States Patent [19]

Ruger et al.

[11] Patent Number: 4,674,216

[45] Date of Patent: Jun. 23, 1987

[54] SYNTHETIC MATERIAL RIFLE STOCK WITH PANEL INSERTS

[75] Inventors: William B. Ruger, Croydon, N.H.; Lawrence L. Larson, Branford, Conn.

[73] Assignee: Sturm, Ruger & Company, Inc., Southport, Conn.

[21] Appl. No.: 804,571

[22] Filed: Dec. 4, 1985

[51] Int. Cl.[4] ..... F41C 23/00

[52] U.S. Cl. ..... 42/71.01

[58] Field of Search ..... 42/71.01, 71, .02

[56] References Cited

U.S. PATENT DOCUMENTS

| | | | |
|---|---|---|---|
| 1,693,289 | 11/1928 | Warren | 42/71.01 |
| 2,331,372 | 10/1943 | Buchanan | 42/71.01 |
| 2,701,930 | 2/1955 | Dolan | 42/71.01 |
| 2,753,642 | 7/1956 | Sullivan | 42/71.01 |
| 3,011,283 | 12/1961 | Lunn et al. | 42/71.01 |
| 3,023,527 | 3/1962 | Leek et al. | 42/71.01 |

*Primary Examiner*—Deborah L. Kyle
*Assistant Examiner*—Ted L. Parr
*Attorney, Agent, or Firm*—Pennie & Edmonds

[57] ABSTRACT

A rifle stock having its forearm, mid-stock and butt section comprised of a one piece plastic structural framework together with attached insert panels. The plastic framework is a lightweight readily moldable structure consisting of web walls having thicknesses, spacing and openings to facilitate such fabrication. Alternatively, the framework can be made of two or more framework elements fastened together.

The framework has border recess areas for receiving panels of wood or other materials which panels are configured to fit into the recess areas and to be fastened to or urged against the framework recesses to strengthen the rifle stock and provide a more secure feel and pleasing appearance.

9 Claims, 39 Drawing Figures

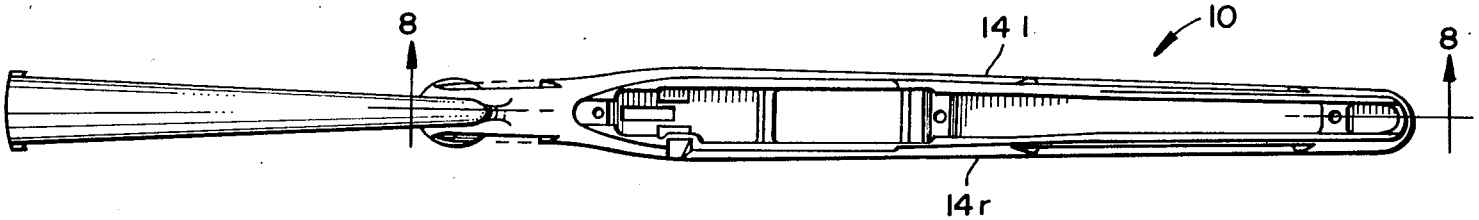
FIG. 2.
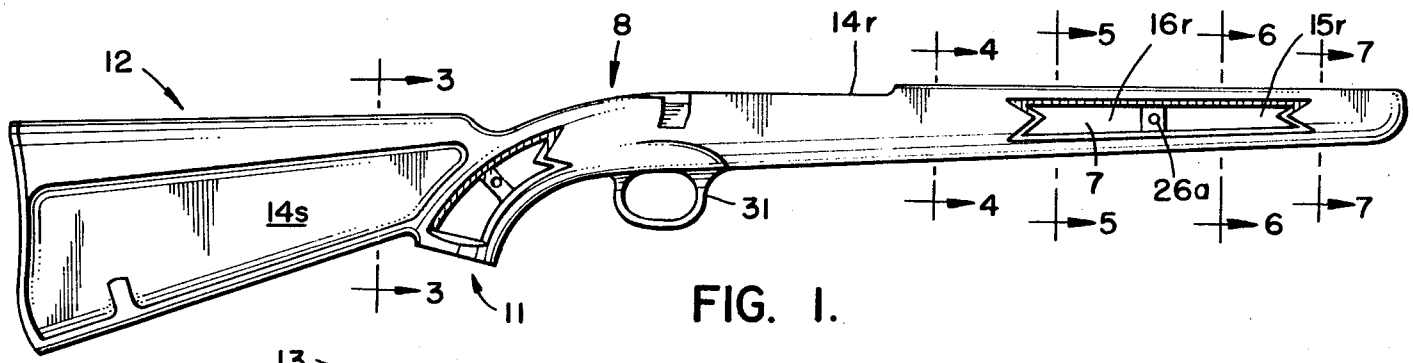
FIG. 1.
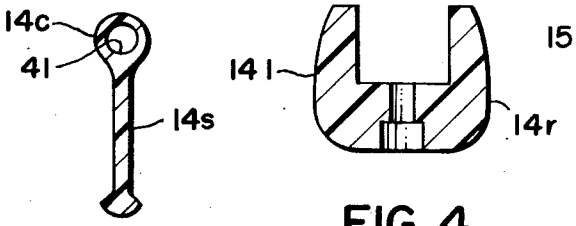
FIG. 3.
FIG. 4.
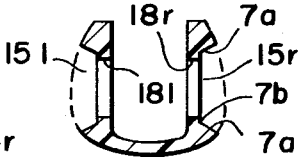
FIG. 5.
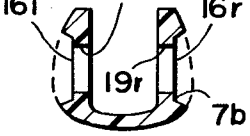
FIG. 6.
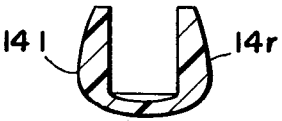
FIG. 7.

11
17
32a
44
33r
35r
32b
16
46r
32r
18
14c
38
14s
14

32r
46r
48r
47r
32b
32a
44
32l 11
40

39l
14c
39r 31
15
52
36r 46r
48r
49
36l
51
36r
48l 14c
14s
38

SYNTHETIC MATERIAL RIFLE STOCK WITH PANEL INSERTS

BACKGROUND OF THE INVENTION

Prior rifle stocks have been made of wood or synthetic materials. Decorations and checkering have been carved, embossed or otherwise impressed in the stocks. Rifle stocks have also been made of plastic materials such as ABS (acrylonitrile-butadiene-styrene) polymers, phenol and nylon. Some plastic material stocks have carried patterns which simulate wood graining.

With synthetic stocks, excessive weight (compared to wood) has been a problem. Various lightening solutions have been attempted, but often at the expense of strength. Also, synthetic stock materials lack the warmth and "feel" of wood.

SUMMARY OF THE INVENTION

Broadly, the present invention is a rifle stock having its forearm, mid-stock and butt sections comprised of a one piece plastic structural framework together with attached insert panels. The plastic framework is a lightweight readily moldable structure consisting of web walls having thicknesses, spacing and openings to facilitate such fabrication. Alternatively, the framework can be made of two or more framework elements fastened together.

It is a feature that the framework has border recess areas for receiving panels of wood or other materials which panels are configured to fit into the recess areas and to be fastened to or urged against the framework recesses to strengthen the rifle stock and provide a more secure feel and pleasing appearance.

BRIEF DESCRIPTION OF THE DRAWINGS

FIG. 1 is a right side elevational view of the rifle stock of the present invention;

FIG. 2 is a plan view of the rifle stock;

FIG. 3 is a sectional view taken along line 3—3 of FIG. 1;

FIG. 4 is a sectional view taken along line 4—4 of FIG. 1;

FIG. 5 is a sectional view taken along line 5—5 of FIG. 1;

FIG. 6 is a sectional view taken along line 6—6 of FIG. 1;

FIG. 7 is a sectional view taken along line 7—7 of FIG. 1;

DESCRIPTION OF THE PREFERRED EMBODIMENT

Figure 8:
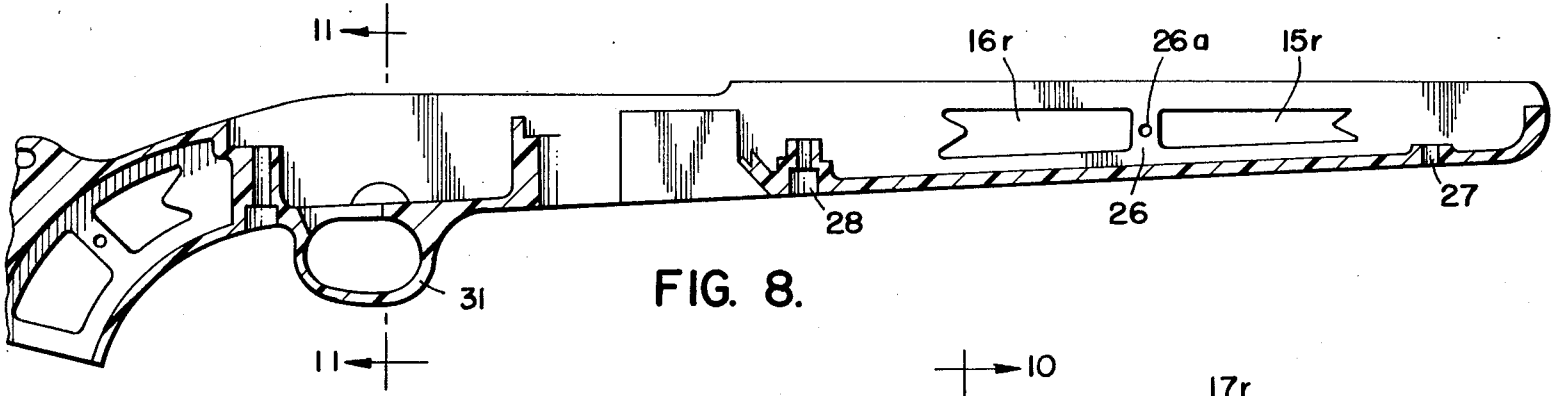
FIG. 8 is a sectional view taken along line 8—8 of FIG. 2.

In the embodiment shown in FIGS. 1–18, rifle stock 8 includes forearm stock section 10, mid-stock section 11 and butt stock section 12. Stock 8 is integrally formed by injection molding or other fabrication technique. Stock 8 may also be made in frame elements and assembled using suitable connector means. Rifle stock 8 includes a continuous framework web structure 13 having numerous web walls 14 both vertically and horizontally positioned. The thickness and spacing of web walls 14 is such that they are readily formed using standard commercial fabricating techniques such as injection molding, lamination or other industrial process. The preferred materials are nylon, nylon-based materials, ABS, fiberglass or other suitable synthetic materials, herein referred to as "synthetic materials".

Preferably, the fabricated structure is formed using injection molding techniques in which mold cavities are sized, shaped and designed to provide ease of molding at speeds and economies in accordance with current practices in the injection molding industry. Web walls 14 have selected thicknesses and spaced recess openings consistent with ease of fabrication by injection molding as sought by this invention, leaving further required strength, rigidity and appearance to be accomplished by the use of insert panels and fastener means holding the inserts in place.

Butt stock web walls 14 include central vertical stock wall 14*s* and stock cylindrical wall 14*c*. Web walls 14 also include forearm left vertical wall portion 141, right vertical wall 14*r* and forearm base wall 14*b* (see FIGS. 4–7). Forearm stock walls 141 and 14*r* have pairs of panel-receiving wall recesses 15*r*, 16*r* and 151 and 161 having border portions 7*r* and 71 for receiving wooden insert panels 17*r* and 171. Recesses 15*r*, 16*r*, 151 and 161 are part of openings 18*r*, 181, 19*r* and 191 in the stock walls 14*r* and 141. Border portions 7*r* and 71 include angled-intersecting seat planes 7*a* and 7*b*. Walls 141 and 14*r* also include frame opening 18*r*, 181, and 19*r*, 191 to facilitate the molding operation and to reduce weight while still providing sufficient structural strength.

Figure 9:
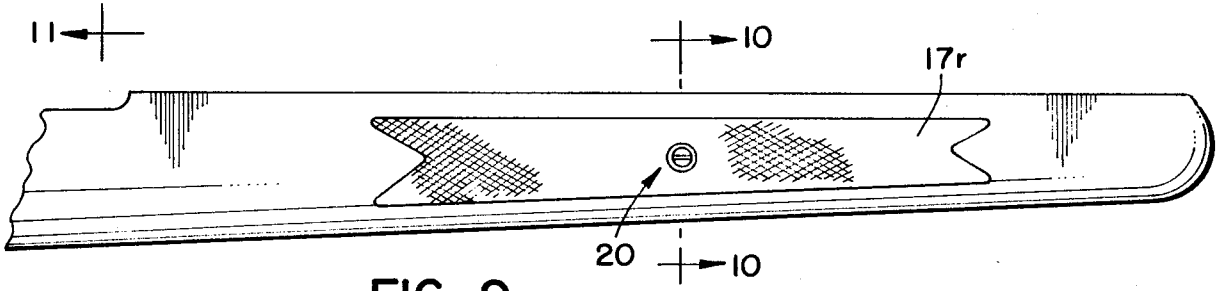
FIG. 9 is an enlarged partial right side elevational view of a forward portion of the stock.
Figure 10:
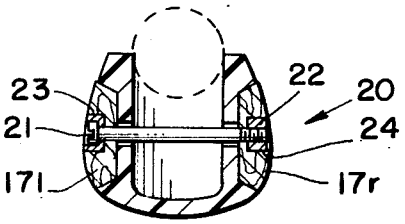
FIG. 10 is a sectional view taken along line 10—10 of FIG. 9.

Fastener assembly 20 secures panels 17*r* and 171 in recesses 16*r* and 161 (see FIGS. 9 and 10). Fastener assembly 20 includes headed bolt 21 and threaded nut 22 which bolt and nut are nested in fastener-receiving panel indents 23 and 24, respectively, to provide a flush appearance. Panels 17*r* and 171 may be raised (rather than flush) if desired. Bolt 21 passes through opening 26*a* in spacer piece 26 (FIGS. 1 and 8). Fastener assembly 20 urges panels 17*r* and 171 in tensioned engagement against border portions 7*r* and 71 including seat planes 7*a* and 7*b*.

Figure 11:
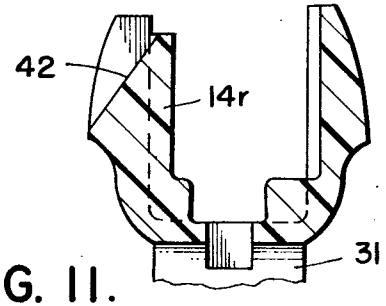
FIG. 11 is a sectional view taken along line 11—11 of FIG. 8.

Insert panels 17*r*, 171 function to structurally strengthen framework web structure 13 and also function through color and texture, to provide a decorative quality to stock 8. Preferably panels 17*r* and 171 are made of wood but other similar materials or synthetic materials may also be used provided they afford required stiffness and the desired feel and appearance. Base web walls 14*b* include rifle mechanism mount openings 27 and 28 for mounting or otherwise securing the rifle mechanism (not shown) to stock 8 (FIG. 8). Base wall 14*b* also includes integrally-formed trigger guard 31. Also shown in FIG. 11 is wall cutout portion 42 in right forearm wall 14*r* to accommodate the rifle bolt (not shown).

Figures 12, 13, 14, 15, 16, 17, 18:
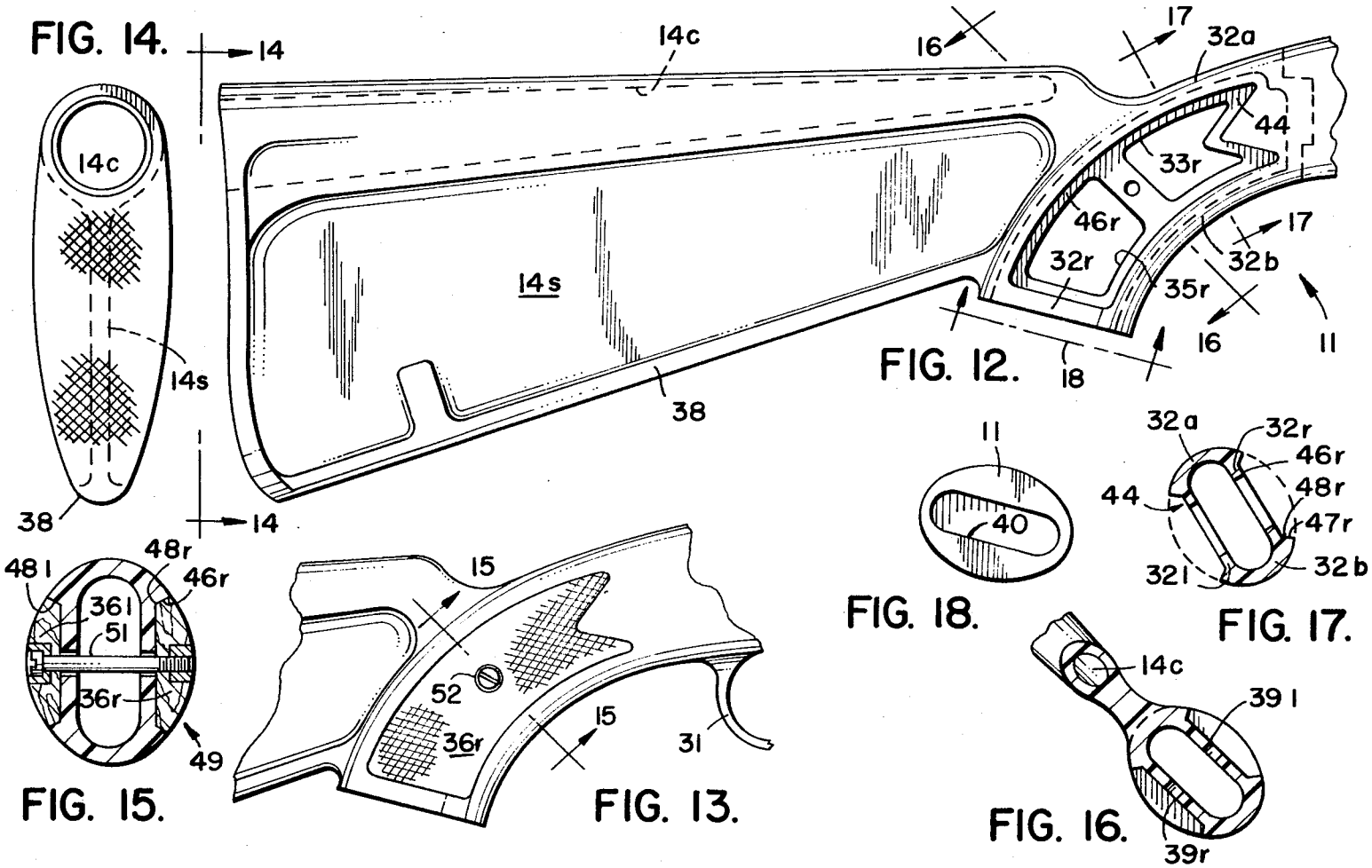
FIG. 12 is an enlarged partial right side elevational view of the rearward butt portion of the stock.
FIG. 13 is an enlarged partial right side elevational view of the mid-stock portion of the stock.
FIG. 14 is a rearward elevational view of the stock.
FIG. 15 is a sectional view taken along line 15—15 of FIG. 13.
FIG. 16 is a sectional view taken along line 16—16 of FIG. 12.
FIG. 17 is a sectional view taken along line 17—17 of FIG. 12.
FIG. 18 is a view taken along line 18—18 of FIG. 12.

Turning to FIGS. 12–16, rearward of trigger guard 31 is the mid-stock section 11 including mid-stock web walls 32*r*, 321, upper mid-stock wall 32*a* and mid-stock base wall 32*b*. Mid-stock wall recess pairs 33*r*, 331 and 35*r* and 351 carry configured panel inserts 36*r* and 361. Referring further to FIGS. 12 and 14, butt stock section 12 is formed with a molded central vertical web 14*s* with lower base piece 38 and upper hollow cylindrical curved piece 14*c*. Curved piece 14*s* has cylindrical hollow 41 (see FIGS. 3 and 14).

In FIGS. 15–18, mid-stock panels 36*r*, 361 are configured to be positioned in panel-receiving border portions 44. Border portions 44 includes planar seating surfaces 46*r*, 461, 47*r*, 471 which intersect at and define periphery lines 48*r*, 481. Fastener assembly 49 includes bolt 51 and nut 52 (FIGS. 13 and 15) for urging panels 36*r*, 361 against seating border portions 46*r*, 461 to strengthen the framework. Also shown are bridge plate pieces 39*r* and 391. Mid-stock section 11 has opening 40 (see FIG. 18).

Figures 19, 20, 21, 22, 23, 24:
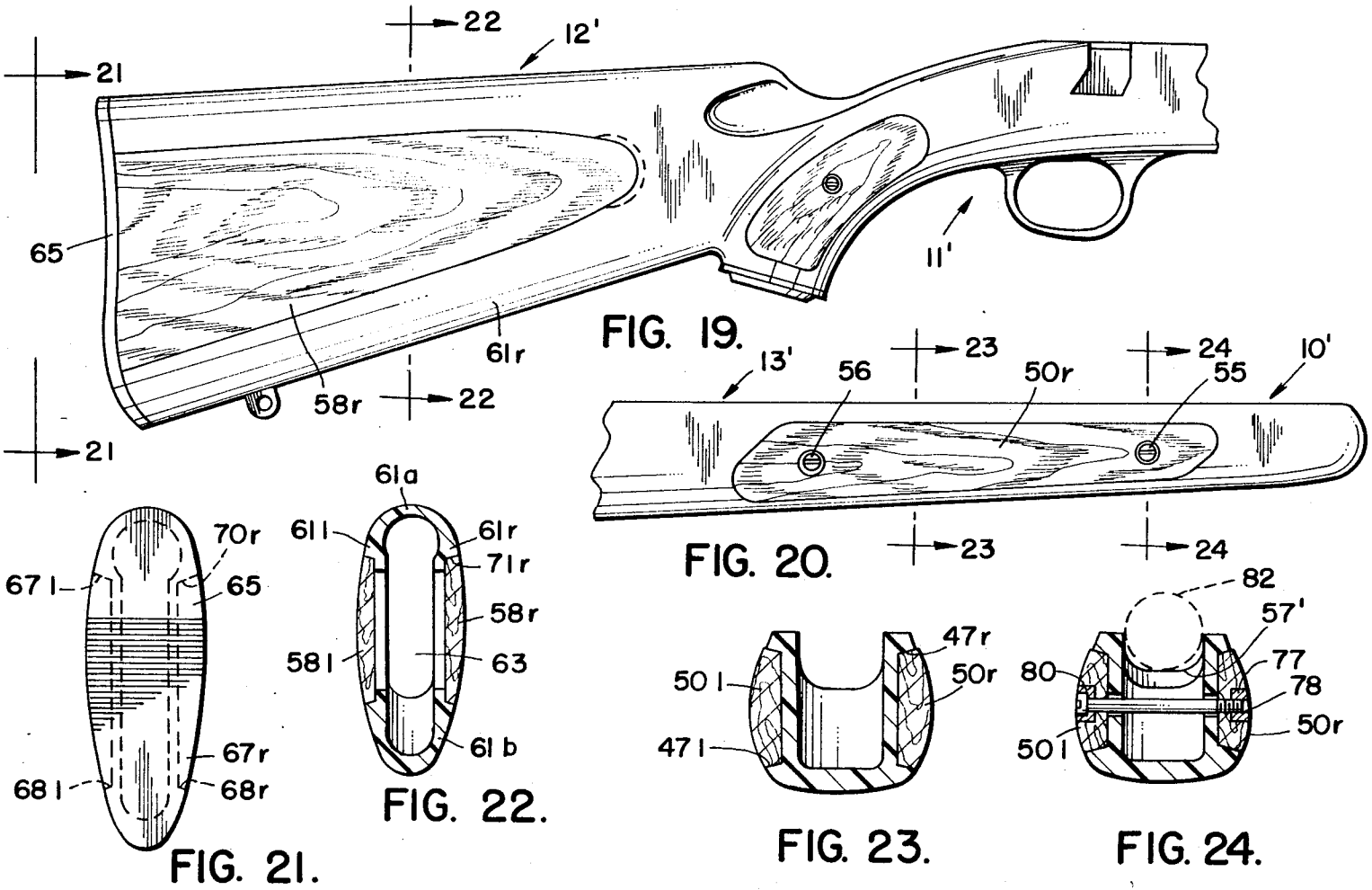
FIG. 19 is a partial right side elevational view of the butt portion of an alternative embodiment of the stock.
FIG. 20 is a partial right side elevational view of the forearm portion of an alternative embodiment of the stock.
FIG. 21 is a view taken along line 21—21 of FIG. 19.
FIG. 22 is a sectional view taken along line 22—22 of FIG. 19.
FIG. 23 is a sectional view taken along line 23—23 of FIG. 20.
FIG. 24 is a sectional view taken along line 24—24 of FIG. 20.
Figure 25:
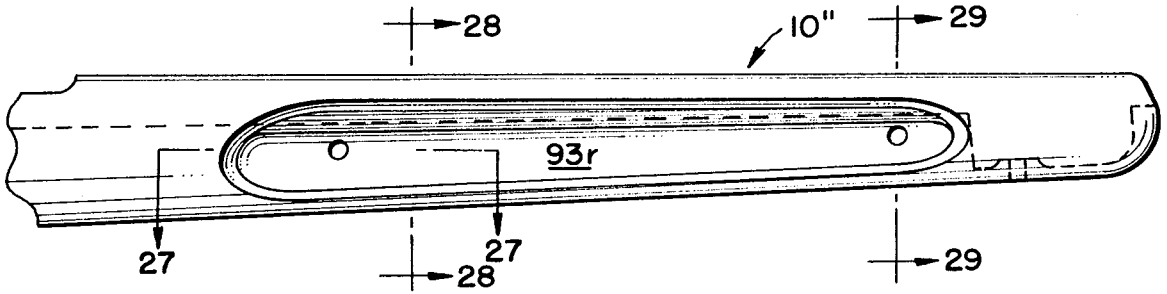
FIG. 25 is a partial right side elevational view of a third embodiment of the stock.
Figure 26:
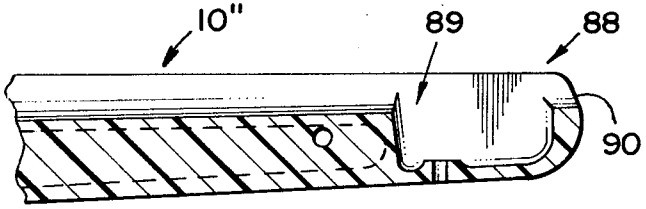
FIG. 26 is a sectional view taken along line 26—26 of FIG. 29.

Turning to FIGS. 19–24, an alternative embodiment of the invention is shown in which the forearm and mid-stock insert panels differ in shape and in fastening arrangement. Forearm panels 50*r*, 501 are secured with two (2) fastener assemblies 55, 56 and the forward end of the firearm stock sectin 10' carries a barrel-supporting piece 57'. In FIG. 22, butt stock right wall 61*r*, butt stock left wall 611, upper wall 61*a* and base wall 61*b* form a hollow chamber 63 in butt stock 12' which chamber 63 extends from top to bottom. A butt cushion piece 65 covers the end of butt stock section 12' cushion piece 65 covers the end of butt stock section 12' (FIG. 21). Right and left butt panels 58*r*, 581 are mounted in right and left panel-receiving recessed border portions 67*r*, 671. Each border portion 67*r*, 671 includes seating surfaces 68*r*, 681 and 70*r*, 701 intersecting along periphery lines 71*r*, 711. In FIGS. 20, 23, and 24, forearm panels 50*r*, 501 are shown in forearm panel-receiving border portions 74*r*, 741. Forward fastener assembly 55, including headed bolt 76 and threaded nut 77, are nested in panel recesses 78, 80 to provide a flush appearance. Barrel 82 rests on barrel-supporting piece 57, (FIG. 24).

Figure 29:
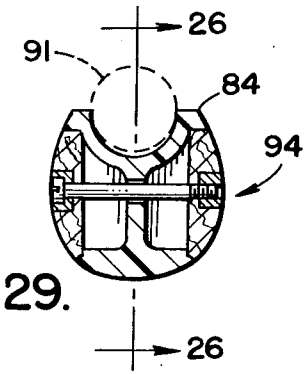
FIG. 29 is a sectional view taken along line 29—29 of FIG. 25.
Figure 28:
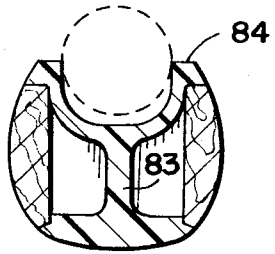
FIG. 28 is a sectional view taken along line 28—28 of FIG. 25.
Figure 27:
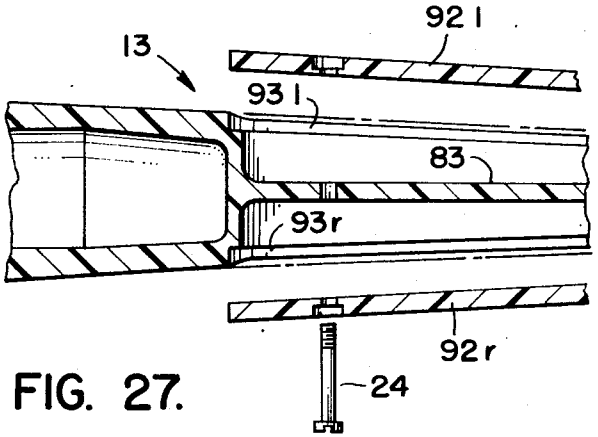
FIG. 27 is an exploded sectional view taken along line 27—27 of FIG. 25.

Referring to FIGS. 25–29, a further embodiment shows a structural forearm central web wall 83 and upper saddle wall 84 and base wall 86. Forward nose section 88 of forearm stock section 10" includes nose wall opening 89 to accommodate rifle parts (not shown). The forward portion of stock nose saddle wall portion 84 supports barrel 91 (FIG. 29). Also shown are forearm panels 92*r*, 921 positioned in border areas 93*r*, 931 and urged against frame web structure 13" by fastener assembly 94.

Figure 30:
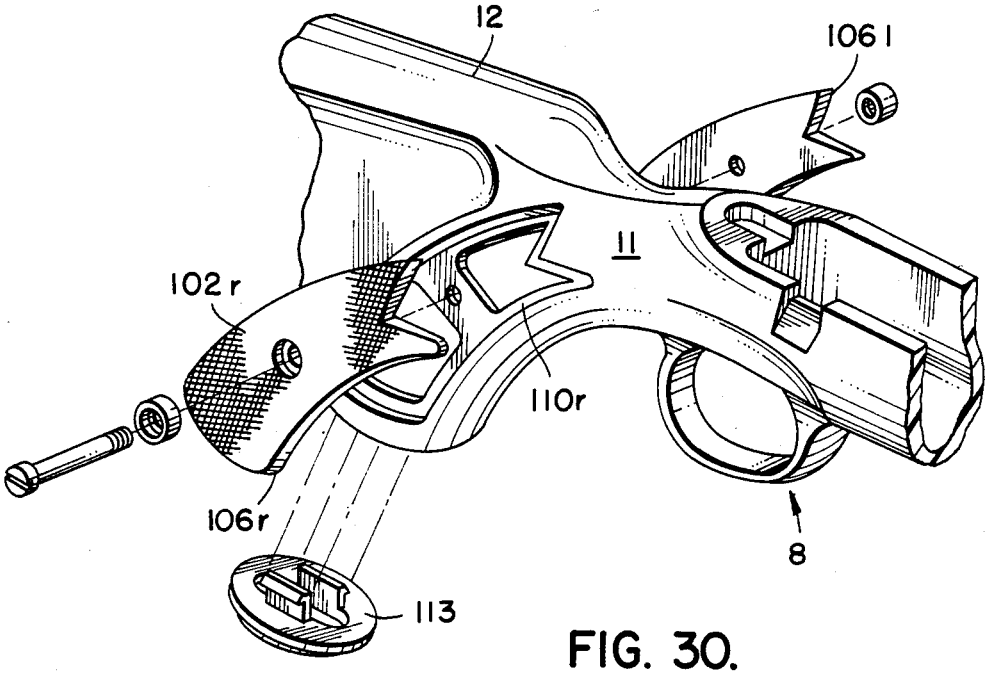
FIG. 30 is a partial exploded perspective view of the mid-stock portion of a fourth embodiment.
Figure 31:
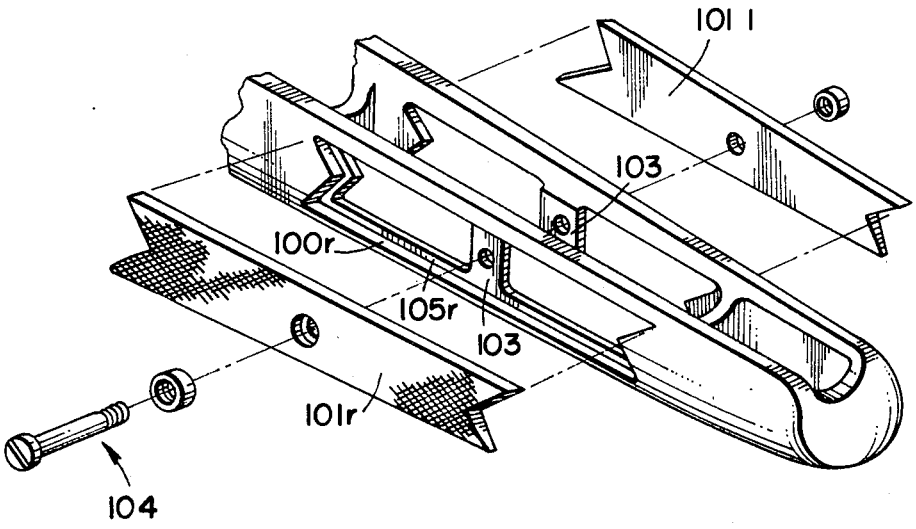
FIG. 31 is a partial exploded perspective view of the forearm portion of such embodiment.
Figure 32:
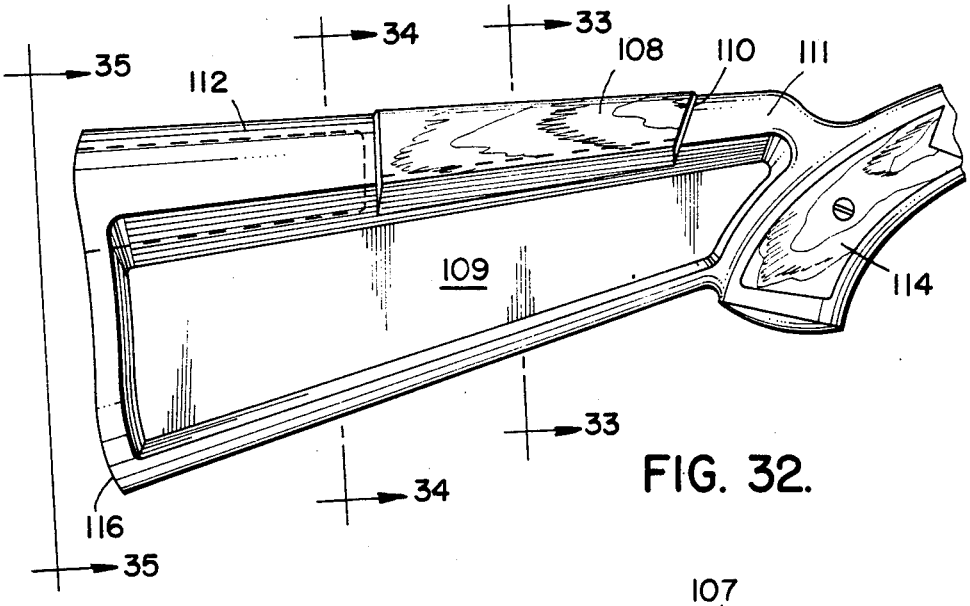
FIG. 32 is a fifth embodiment in partial right side elevational view showing a butt stock mold recess receiving a cheek panel.
Figure 35:
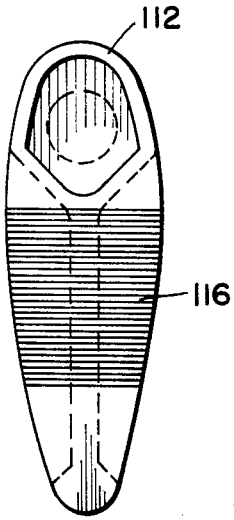
FIG. 35 is an end elevational view along lines 35—35 of FIG. 32.
Figure 34:
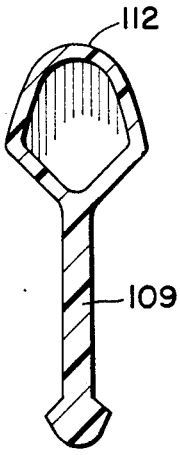
FIG. 34 is a sectional view taken along line 34—34 of FIG. 32.

FIGS. 30 and 31 illustrate in perspective another embodiment in which forearm panel seating surfaces 100*r*, 1001 (not shown) are parallel to the plane of forearm panel inserts 101*r* and 1011. Panels 101*r*, 1011 abut frame pieces 103*r* and 1031 and abut frame border areas 105*r* and 1051 as urged by fastener assembly 104. Mid-stock panels 102*r*, 1021 are similarly constructed with generally perpendicular edges 106*r*, 1061. Panels 102*r*, 1021 abut border areas 110*r* and 1001. Cap 113 is also shown.

Figure 33:
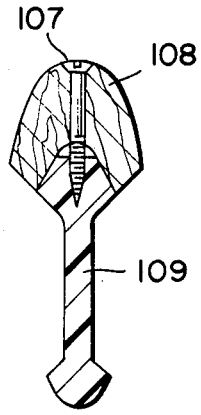
FIG. 33 is a sectional view taken along line 33—33 of FIG. 32.
Figure 36:
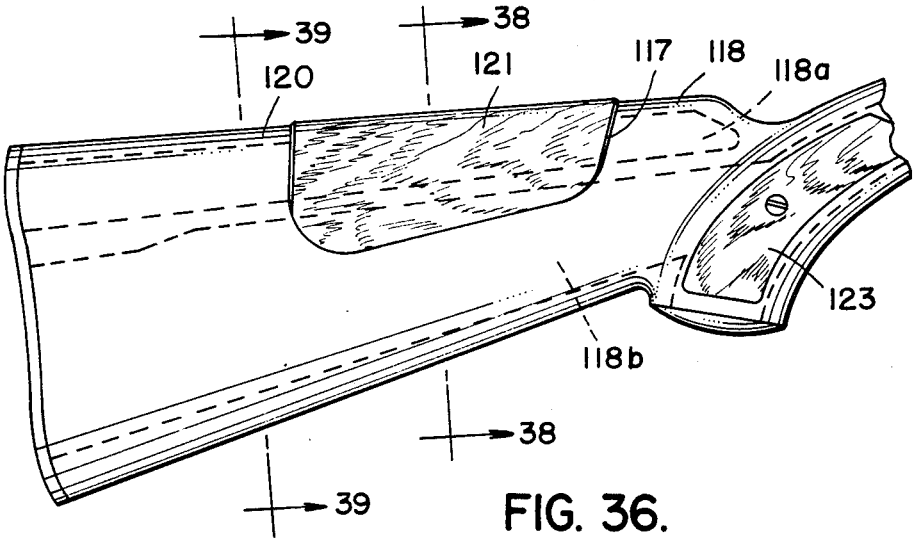
FIG. 36 is a sixth embodiment in partial right side elevational view showing a butt stock mold recess and cheek panel.
Figure 39:
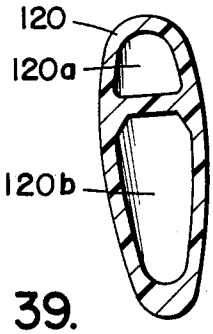
FIG. 39 is a sectional view taken along line 39—39 of FIG. 36.
Figure 38:
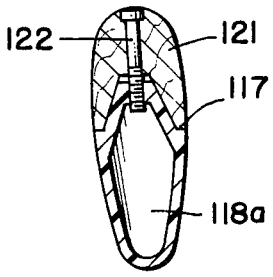
FIG. 38 is a sectional view taken along line 38—38 of FIG. 36.
Figure 37:
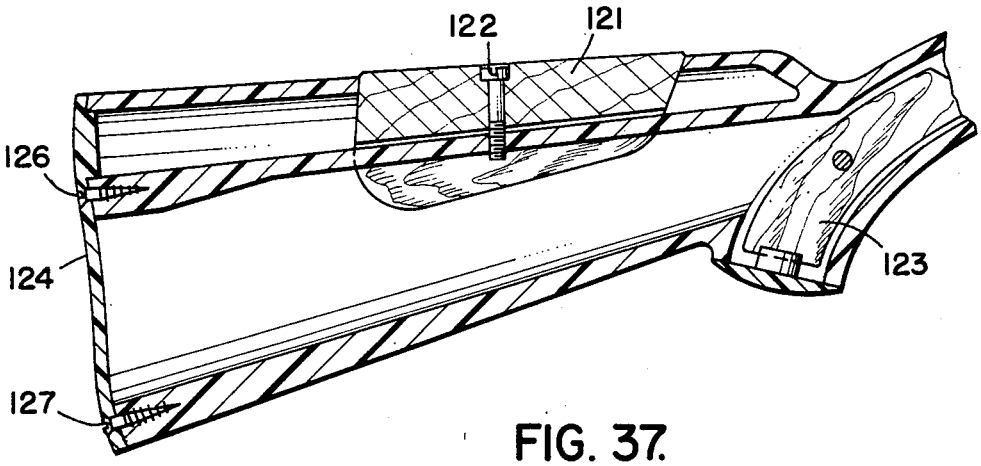
FIG. 37 is a longitudinal sectional view of the butt stock taken through a vertical centerline of the butt stock of FIG. 36.

Turning next to FIGS. 32–35, a further embodiment shows U-shaped butt insert cheek panel 108 secured to butt stock web section 109 using fastener 107 (FIG. 33). Stock section 109 has recess 110 between hollow forward butt portion 111 and hollow rearward butt portion 112. Also shown are midstock insert panel 114 and butt stock end portion 116.

Finally, turning to FIGS. 36—39, a modified cheek panel embodiment is shown in which the butt stock recess 117 between forward butt portion 118 and rearward butt portion 120 carries wooden panel cheek insert 121. Wood has a "warmer" feel than synthetic materials and therefore serves as a desirable cheek panel. Butt portions 118, 120 form upper and lower inner butt chambers 118*a*, 118*b* and 120*a*, 120*b*. Also shown are fastener 122, mid-stock panel 123, butt end plate 124 and butt end plate screws 126, 127.

We claim:

1. A rifle stock including a forearm section, a mid-stock section and a butt section comprising a fabricated synthetic material structural framework positioned in at least one of such stock sections which framework in turn comprises a framework wall;

a configured recess opening in such framework wall;

a configured insert panel positioned in the recess opening; and fastener means for urging the insert panel as located in the recess opening, into tensioned engagement against the framework wall to increase the strength of the framework wall.

2. The rifle stock of claim 1 in which said framework is integrally-formed and extends throughout each of the stock sections.

3. The rifle stock of claim 1 in which the recess includes a configured seating area and the panel is so configured that it engages the such seating area under action of the fastener means to strengthen the framework.

4. The rifle stock of claim 1 in which the framework comprises spaced-apart readily moldable web sections providing light weight and strength.

5. The rifle stock of claim 1 in which the framework comprises a central web section, an upper web section and a base section.

6. The rifle stock of claim 1 in which the framework is injection molded.

7. The rifle stock of claim 1 in which the recess is part of an opening in the framework.

8. The rifle stock of claim 1 in which the insert panel is wood.

9. The rifle stock of claim 1 in which the insert panel is made of synthetic material.

* * * * *